United States Patent [19]

Bloem et al.

[11] 4,093,889

[45] June 6, 1978

[54] LOW-PRESSURE MERCURY VAPOR DISCHARGE LAMP

[75] Inventors: Jan Bloem; Albert Bouwknegt, both of Eindhoven, Netherlands

[73] Assignee: U.S. Philips Corporation, New York, N.Y.

[21] Appl. No.: 765,097

[22] Filed: Feb. 3, 1977

[30] Foreign Application Priority Data

Apr. 3, 1976 Netherlands ..... 7602232

[51] Int. Cl.[2] ..... H01J 61/18

[52] U.S. Cl. ..... 313/229; 313/187; 313/490

[58] Field of Search ..... 313/229

[56] References Cited

U.S. PATENT DOCUMENTS 3,521,110 7/1970 Johnson ..... 313/229 X

*Primary Examiner*—Rudolph V. Rolinec
*Assistant Examiner*—Darwin R. Hostetter
*Attorney, Agent, or Firm*—Frank R. Trifari; Robert S. Smith

[57] ABSTRACT

A low-pressure mercury vapor discharge lamp, having a discharge space containing thermally emitting electrodes and a mercury amalgam which is composed of mercury, bismuth, tin and lead.

This amalgam causes the mercury vapor pressure to remain stable at the value of $6 \times 10^{-3}$ torr which is the optimum value for the conversion of electric energy into ultraviolet radiation over a wide temperature range. In addition, the mercury vapor pressure at room temperature is still sufficiently high to ensure rapid starting.

4 Claims, 2 Drawing Figures

LOW-PRESSURE MERCURY VAPOR DISCHARGE LAMP

The invention relates to a low-pressure mercury vapour discharge lamp having a discharge space containing two thermally emitting electrodes and a mercury amalgam.

Low-pressure mercury vapour discharge lamps have a maximum efficiency of the conversion of the electric energy supplied into ultraviolet radiation when the mercury vapour pressure is approximately $6 \times 10^{-3}$ torr during operation of the lamp. This is a vapour pressure which is in equilibrium with liquid mercury having a temperature of approximately 40° C.

The operating temperature of a discharge lamp is predominantly determined by the quantity of energy which is supplied to the lamp and by the temperature of the environment in which it burns. If the applied energy increases considerably or if at the same applied energy, the ambient temperature exceeds a given value then the vapour pressure in the lamp increases and the conversion efficiency of electric energy to ultraviolet radiation consequently decreases.

A known method of maintaining the mercury vapour pressure in the discharge space as closely as possible to a value of $6 \times 10^{-3}$ torr in spite of the increase in the temperature by one of the above-mentioned causes, consists in the use of a mercury amalgam. The amalgam is preferably provided at a location which at the prescribed operating condition is at a temperature such that the mercury vapour pressure above the amalgam assumes a value which deviates as little as possible from $6 \times 10^{-3}$ torr.

Although the use of an amalgam in the lamp results in a high conversion efficiency at temperatures which exceed 40° C it is known that lamps containing amalgam do not start as well at room temperature as lamps without an amalgam. This is caused by the fact that the mercury vapour pressure at room temperature in lamps with an amalgam is lower than with lamps with pure mercury. Furthermore, after starting the lamp it takes rather a long time before the vapour pressure reaches the optimum value for the above-mentioned conversion so that after starting the light output remains for a considerable period of time at a comparatively low level.

In order to obviate the above-mentioned drawbacks which are coupled to the use of amalgam in the lamp German patent specification No. 1,274,228 proposes to apply a second amalgam at a location in the lamp where the temperature is higher than elsewhere in the lamp, for example in the immediate surroundings of an electrode.

In contrast with the first mentioned amalgam which has a vapour pressure-controlling character this second amalgam has the function of supplying mercury to the discharge space atmosphere. This second amalgam is so heated by the electrodes immediately after switch-on of the lamp that it rapidly reaches a temperature at which a considerable quantity of mercury evaporates from the second amalgam. In this manner the mercury vapour pressure in the lamp quickly reaches such a value that starting proceeds readily.

The invention provides a low-pressure mercury vapour discharge lamp having a discharge space containing two thermally emitting electrodes and a mercury amalgam and is characterized in that the amalgam is composed of mercury, bismuth, tin and lead.

The advantage of the use of an amalgam of mercury, bismuth, tin and lead in the lamp is that at room temperature the mercury vapour pressure in the discharge space is substantially as high as the mercury vapour pressure in lamps which contain pure mercury only. The result thereof is that lamps according to the invention start readily at room temperature. Thus it is not necessary to use a second amalgam which is exclusively used as a starting amalgam, that is to say for rapidly raising the mercury pressure by releasing mercury in a low-pressure mercury vapour discharge lamp according to the invention.

The ratio of the sum of the number of atoms of bismuth, tin and lead to the number of atoms of mercury the amalgam is preferably between 0.85:0.15 and 0.98:0.02. At these ratios the value of the mercury vapour pressure over a wide temperature range does not deviate much from the value of $6 \times 10^{-3}$ torr which is the optimum value for the conversion of electric energy into U.V. radiation. This value is reached already at a comparatively low temperature of the amalgam.

A ratio of the sum of the number of atoms of bismuth, tin and lead to the number of atoms of mercury in the amalgam between 0.85:0.15 and 0.94:0.06 is particularly advantageous as then, at room temperature, the mercury vapour pressure is not only relatively high but it also appears that the value of the mercury vapour pressure in the above-mentioned proportions hardly changes at room temperature as a function of the mercury content of the amalgam. Reducing the mercury content of the amalgam, for example by absorption of mercury in the fluorescent layer, then results less quickly in a poorer ignition, owing to a reduction in the mercury vapour pressure than with an amalgam having a lower mercury content.

It is possible to introduce the amalgam as a whole but it is also possible to introduce an alloy of bismuth, tin and lead separate from the mercury. The advantage of such a method is that the quantity of mercury can then be dosed very accurately, for example by means of a mercury capsule disposed within the lamp, as disclosed in United Kingdom patent specification No. 1,267,175. The alloy of bismuth, tin and lead is, for example, applied to the stemfoot, to the wall or in the exhaust tube.

A composition of an alloy in which the ratio of the number of atoms of bismuth to the number of atoms of tin to the number of atoms of lead is 48:24:28 is favourable, because there is a eutectic at this ratio and so demixing into the separate components hardly occurs during the production of the alloy.

An embodiment of the invention will be further explained with reference to a drawing.

In the drawing

Figure 1:
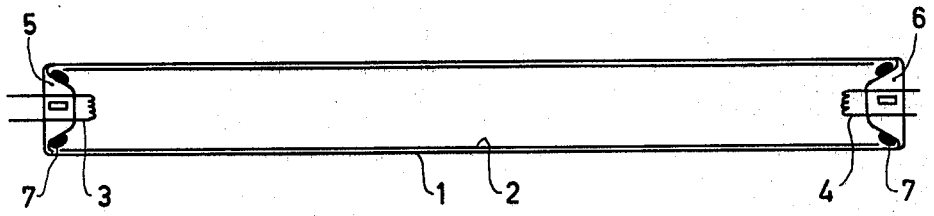
FIG. 1 shows a diagrammatic longitudinal section of a low-pressure mercury vapour discharge lamp provided with an amalgam according to the invention.

The lamp as shown in FIG. 1 has a glass envelope 1, provided with a luminescent layer 2, for example calcium halophosphate activated by manganese and antimony. The lamp is filled with mercury vapour and a rare gas or a combination of rare gases, for example, argon and neon at a pressure of 2 to 4 torr. Thermally emitting electrodes 3 and 4 respectively are disposed one at each end of the envelope 1. In the discharge space there is on each stem 5 and 6 125 mg of an alloy of bismuth, tin and lead 7 to which 15 mg of mercury is added which can form an amalgam with the alloy.

Figure 2:
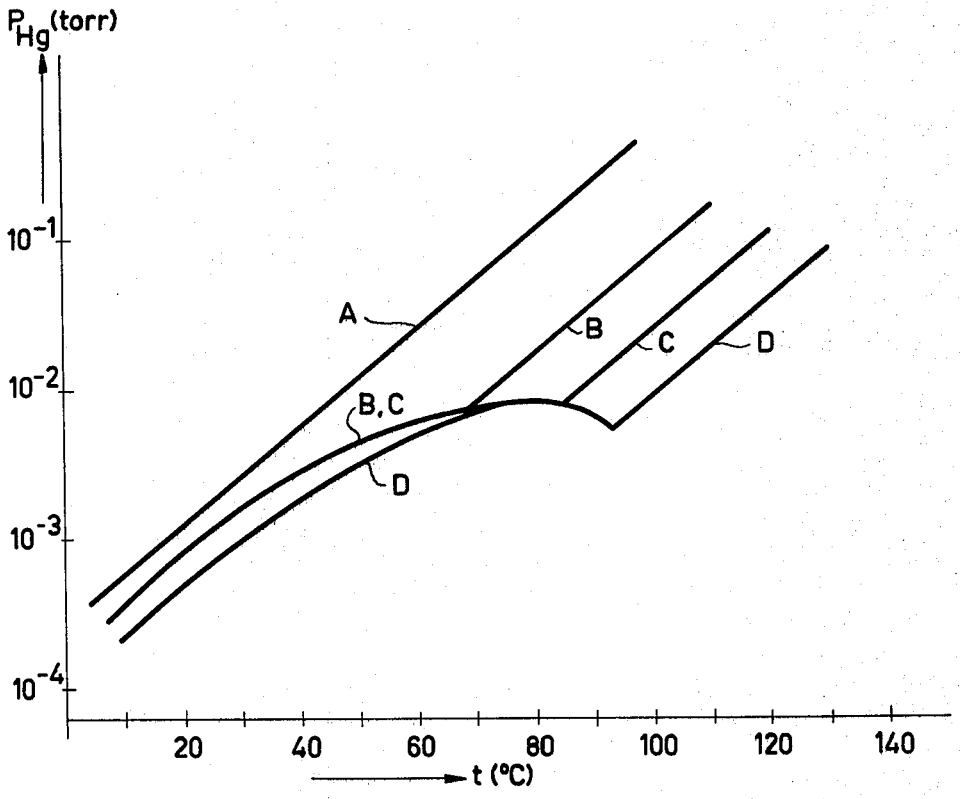
FIG. 2 is a graphical representation of the mercury vapour pressure in said lamp plotted logarithmically as a function of the temperature for pure mercury and various amalgams composed of mercury, bismuth, tin and lead.

In FIG. 2 the curve which shows the mercury vapour pressure over pure mercury as a function of the temperature is indicated by A. The curves which show the mercury vapour pressure over different amalgams of mercury, bismuth, tin and lead as a function of the temperature are indicated by B, C and D respectively. Curve B represents the vapour pressure for an amalgam having an atomic ratio of mercury to bismuth to tin and to lead of 12:42:21:25. Curve C relates to the mercury vapour pressure over an amalgam having atomic ratios of Hg:Bi:Sn:Pb of 6:45:23:26. Finally, curve D relates to the mercury vapour pressure over an amalgam having atomic ratios of 3:47:23:27. This graph shows that the vapour pressure over one of these amalgams at the same temperature always is lower than the vapour-pressure of pure mercury. It furthermore appears that the vapour pressure over the amalgam is comparable, at temperatures below 35° C to that of pure mercury. This results in that lamps provided with amalgams of compositions B, C and D readily start at these temperatures. The graph furthermore shows that if the percentage of mercury in the amalgam decreases the temperature range in which the vapour pressure stabilizes becomes wider. Furthermore, it appears that curves B and C substantially coincide below 70° C in spite of the different ratios of mercury to the other components. Curve D shows that if the percentage of mercury in the amalgam decreases to values below five the mercury vapour pressure curves at temperatures below 70° C are situated slightly lower than at higher percentages.

The atomic ratios of bismuth to tin to lead for the curves B, C and D are near the eutecticum 48:24:28; slight deviations in the composition of the Bi-Sn-Pb mixture from this eutectic composition are possible, provided that the temperature of the solidifying point of the mixture does not deviate by more than 5° C from the solidifying temperature of the eutectic composition.

What is claimed is:

1. A low-pressure mercury vapour discharge lamp which comprises a discharge space and disposed in said space two thermally emitting electrodes and a mercury amalgam composed of mercury, bismuth, tin and lead.

2. A low-pressure mercury vapour discharge lamp as claimed in claim 1 wherein the ratio of the sum of the number of atoms of bismuth, tin and lead to the number of atoms of mercury is between 0.85:0.15 and 0.98:0.02.

3. A low-pressure mercury vapour discharge lamp as claimed in claim 1 wherein the ratio of the sum of the number of atoms of bismuth, tin and lead to the number of atoms of mercury, is between 0.85:0.15 and 0.94:0.06.

4. A low-pressure mercury vapour discharge lamp as claimed in claim 1 wherein the ratio of the number of atoms of bismuth to the number of atoms of tin to the number of atoms of lead is approximately the eutectic ratio 48:24:28.

* * * * *